US005573337A

United States Patent [19]

Yasuoka

[11] Patent Number: 5,573,337

[45] Date of Patent: Nov. 12, 1996

[54] PRINTER WITH DEVICE FOR NOISE LEAKAGE REDUCTION

[75] Inventor: Tadashi Yasuoka, Tokyo, Japan

[73] Assignee: Seiko Precision Inc., Tokyo, Japan

[21] Appl. No.: 444,843

[22] Filed: May 18, 1995

Related U.S. Application Data

[63] Continuation of Ser. No. 217,326, Mar. 24, 1994, abandoned.

[30] Foreign Application Priority Data

Mar. 24, 1993 [JP] Japan ..... 5-065589
Mar. 24, 1993 [JP] Japan ..... 5-065590

[51] Int. Cl.[6] ..... B41J 11/50; B41J 29/08

[52] U.S. Cl. ..... 400/605; 400/616; 400/625; 400/690

[58] Field of Search ..... 400/605, 624, 400/625, 646, 647, 616–616.3, 690, 690.4

[56] References Cited

U.S. PATENT DOCUMENTS 5,100,251 3/1992 Yasuoka ..... 400/616.1
5,139,354 8/1992 Saeki ..... 400/605

FOREIGN PATENT DOCUMENTS 0032064 2/1987 Japan ..... 400/625
0231965 9/1988 Japan ..... 400/605
0069379 3/1991 Japan ..... 400/605
2221898 2/1990 United Kingdom .
8203823 11/1982 WIPO ..... 400/605

*Primary Examiner*—Christopher A. Bennett
*Attorney, Agent, or Firm*—Amster, Rothstein & Ebenstein

[57] ABSTRACT

To provide a printer in which leakage to the outside of noise produced inside the printer during printing using continuous paper is made low. A printer having a cut sheet feeder 5 which automatically feeds paper into a printing portion 4, an opening for cut paper 7 and a tractor 6 which feeds continuous paper to the printing portion to selectively use automatically-fed cut paper, manually-fed cut paper and continuous paper for printing. The printer has a paper receiving tray (manually-fed paper guide plate) 9 which can form the opening portion 7 between itself and a part 1*a* of the printer housing 1. The paper receiving tray is movable between a manual paper-feeding position which it forms the opening portion 7 and during manual paper-feeding guides printed cut paper into the opening portion, an automatic paper-feeding position which forms the opening portion 7 and during automatic paper-feeding receives printed cut paper, and a closed position to close off the opening 7. The tractor 6 is movable between a first position in which it moves the paper receiving tray 9 into the manual paper-feeding position, a second position to move the paper receiving tray 9 into the automatic paper-feeding position and a third position to move the paper receiving tray 9 into the closed position.

3 Claims, 3 Drawing Sheets

PRINTER WITH DEVICE FOR NOISE LEAKAGE REDUCTION

This is a continuation of application Ser. No. 08/217,326 filed on Mar. 24, 1994, now abandoned.

BACKGROUND OF THE INVENTION

This invention relates to a printer capable of selectively using cut paper fed manually and/or cut paper fed automatically and continuous paper for printing.

Hitherto, as printers of this kind, types having the following constructions have been known:

(1) those having an opening portion for cut paper for manually feeding sheets of cut paper into a printing portion between a printing head and a platen inside the printer and having continuous paper feeding means for feeding continuous paper such as fan hold paper into the printing portion and constructed so as to selectively use cut paper fed manually and continuous paper for printing;

(2) those having a cut sheet feeder for automatically feeding sheets of cut paper into a printing portion between a printing head and a platen inside the printer and having continuous paper feeding means for feeding continuous paper to the printing part and constructed so as to selectively use cut paper fed automatically by the cut sheet feeder and continuous paper for printing; and (3) those having a cut sheet feeder for automatically feeding sheets of cut paper into a printing portion between a printing head and a platen inside the printer and an opening portion for cut paper which serves as a manual paper-feeding opening for manually feeding cut paper into the printing portion and also serves as a paper discharge opening for discharging printed cut paper to the outside during automatic paper-feeding, and having continuous paper feeding means for feeding continuous paper to the printing portion and constructed so as to selectively use cut paper, fed automatically by the cut sheet feeder, cut paper fed manually and continuous paper for printing.

However, in all the above conventional printers (1) to (3), because the opening portion for cut paper is always open, and more specifically because the opening portion for cut paper is open even when continuous paper is being used, there has been such a problem that during printing using continuous paper, noise produced inside the printer leaks out to the outside through the opening portion for cut paper.

This invention has been made in view of these problems with the conventional printers, and an object of the invention is to provide a printer which reduces during printing using continuous paper, leakage of noise produced inside the printer out to the outside through the opening portion for cut paper.

SUMMARY OF THE INVENTION

To achieve the above-mentioned object, according to a first present invention, there is provided a printer having an opening portion for cut paper for manually feeding sheets of cut paper into a printing portion between a printing head and a platen inside the printer and having continuous paper feeding means for feeding continuous paper into the printing portion to selectively use manually-fed cut paper and continuous paper for printing, characterized in that: the printer has a manually-fed paper guide plate which during manual paper-feeding guides the cut paper into the opening portion and can form the opening portion between itself and a part of the printer housing; the guide plate is mounted on the printer housing movably between a distant position in which it is distant from said part of the printer housing and forms the opening portion and a closed position where it abuts with said part of the printer housing and closes the opening portion; and the continuous paper feeding means engages with the guide plate and is mounted movably between a first position where the guide plate is moved into the distant position and a second position where the guide plate is moved into the closed position (claim 1).

Further, according to a second present invention, there is provided a printer having a cut sheet feeder which automatically feeds sheets of cut paper into a printing portion between a printing head and a platen inside the printer and having continuous paper feeding means for feeding continuous paper into the printing portion to selectively use cut paper fed automatically by the cut sheet feeder and continuous paper for printing, characterized in that: the printer has an opening portion for cut paper through which printed cut paper which has been automatically fed-in by the cut sheet feeder and printed upon in the printing portion is discharged to the outside; the printer has a paper receiving tray which receives cut paper discharged through the opening portion and can form the opening portion between itself and a part of the printer housing; the paper receiving tray is mounted on the printer housing movably between a distant position where it is distant from said part of the printer housing and forms the opening portion and a closed position where it abuts with said part of the printer housing and closes the opening portion; and the continuous paper feeding means engages with the paper receiving tray and is mounted movably between a first position where the paper receiving tray is moved into the distant position and a second position where the paper receiving tray is moved into the closed position (claim 2).

Still further, according to a third present invention, there is provided a printer having a cut sheet feeder for automatically feeding sheets of cut paper into a printing section between a printing head and a platen inside the printer and having an opening portion for cut paper which serves as a manual paper-feeding opening for manually feeding cut paper into a printing portion and also serves as a paper discharge opening for discharging printed cut paper to the outside during automatic paper-feeding and having continuous paper feeding means for feeding continuous paper into the printing portion to selectively use cut paper fed automatically by the cut sheet feeder, cut paper fed manually and continuous paper for printing, characterized in that: the printer has a paper receiving tray which during manual paper-feeding becomes a guide member which guides cut paper into the opening portion and during automatic paper-feeding becomes a tray which receives printed cut paper, and which can form the opening portion between itself and a part of the printer housing; the paper receiving tray is mounted on the printer housing movably between a manual paper-feeding position in which it is distant from said part of the printer housing and forms the opening portion and during manual paper-feeding guides cut paper into the opening portion, an automatic paper-feeding position which is distant from said part of the printer housing and forms the opening portion and during automatic paper-feeding receives printed cut paper, and a closed position which abuts with said part of the printer housing and closes the opening portion; and the continuous paper feeding means engages with the paper receiving tray and is mounted movably between a first position where the paper receiving tray is moved into the manual paper-feeding position and a second position where the paper receiving tray is moved into the automatic paper-feeding position and a third position where the paper receiving tray is moved into the closed position (claim 3).

DETAILED DESCRIPTION OF PREFERRED EMBODIMENTS

According to the first present invention, when the continuous paper feeding means moves into the first position this feeding means engages with the manually-fed paper guide plate and moves this guide plate into the distant position and as a result of this the guide plate moves away from said part of the printer housing and the opening portion for cut paper is formed, and when the continuous paper feeding means moves into the second position this feeding means engages with the manually-fed paper guide plate and moves this guide plate into the closed position and as a result the guide plate abuts with said part of the printer housing and the opening portion for cut paper is closed.

According to the second present invention, when the continuous paper feeding means moves into the first position, this feeding means moves the paper receiving tray into the distant position and as a result the paper receiving tray moves away from said part of the printer housing and the opening portion for cut paper is formed, and when the continuous paper feeding means moves into the second position this continuous feeding means moves the paper receiving tray into the closed position and as a result the paper receiving tray abuts with said part of the printer housing and the opening portion for cut paper is closed.

According to the third present invention, when the continuous paper feeding means moves into the first position this feeding means moves the paper receiving tray into the manual paper-feeding position and as a result the paper receiving tray moves away from said part of the printer housing and the opening portion for cut paper which serves as a manual paper feeding opening portion is formed and the paper receiving tray can guide manually-fed cut paper into the opening portion, and when the continuous paper feeding means moves into the second position this feeding means moves the paper receiving tray into the automatic paper-feeding position and as a result the paper receiving tray moves away from the part of the printer housing and the opening portion for cut paper which serves as a paper discharge opening is formed and the paper receiving tray can receive automatically-fed printed cut paper, and when the continuous paper feeding means moves into the third position this feeding means engages with the paper receiving tray and moves this tray into the closed position and as a result the paper receiving tray abuts with said part of the printer housing and the opening portion for cut paper is closed.

An embodiment of the invention will be described with reference to the drawings.

FIG. 1 illustrates a printer according an embodiment of the present invention. As shown in FIG. 1, this printer has a printer housing 1, a cut sheet feeder 5 which automatically feeds cut paper into a printing portion 4 between a printing head 2 and a platen 3 inside the printer, a tractor (continuous paper feeding means) 6 which feeds fan hold paper (hereinafter referred to simply as "continuous paper") having ear portions provided with a row of feed holes along both sides into the printing portion 4, and an opening portion for cut paper 7 which serves as a manual paper-feeding opening for manually feeding cut paper into the printing portion 4 and also serves as a paper discharge opening for discharging printed cut paper to the outside during automatic paper feeding, and the printer is capable of printing using cut paper automatically fed by the cut sheet feeder 5, cut paper fed manually and continuous paper selectively.

The printing head 2 is mounted on a carriage 8 and guided by carriage guides 8*a* together with the carriage 8 so as to move back and forth in a direction perpendicular to the surface of the paper of FIG. 1.

The printer also has a paper receiving tray (manually-fed paper guide plate) 9 which during manual paper feeding becomes a guide member for guiding cut paper into the opening portion for cut paper 7 and during automatic feeding becomes a tray for receiving printed cut paper. This paper receiving tray 9 can form the opening portion 7 between its end portion 9*a* and a part 1*a* of the printer housing 1.

The paper receiving tray 9 is pivotally mounted on the printer housing 1 by means of a supporting shaft 9*b*. The paper receiving tray 9 is pivotable between a manual paper-feeding position (the position shown in FIG. 2) where its end portion 9*a* is distant from the part 1*a* of the printer housing 1 and forms an opening portion for cut paper 7 which serves as a manual paper-feeding opening and during manual paper-feeding guides cut paper into the opening portion 7, an automatic paper-feeding position (the position shown in FIG. 1) where its end portion 9*a* is distant from the part 1*a* and forms an opening portion for cut paper 7 which serves as the paper discharge opening and during automatic paper-feeding receives printed cut paper, and a closed position (the position shown in FIG. 3) in which its end portion 9*a* abuts with the part 1*a* and closes the opening portion for cut paper 7.

The cut sheet feeder 5 is, as shown in FIG. 1, removably mounted on an installation portion 1*b* of the printer housing 1. On this cut sheet feeder 5 there are mounted a hopper plate 5*a* onto which cut paper is loaded, a picking roller 5*c* which is disposed inside the cut sheet feeder 5 and which sends out cut paper that has been loaded onto the hopper plate 5*a* downward and through a feeder exit 5*b* into the printer one sheet at a time, and a coil spring 5*d* which urges the hopper plate 5*a* toward the picking roller 5*c* side. During manual paper-feeding, as shown in FIG. 2, and when continuous paper is being used, as shown in FIG. 3, when the cut sheet feeder 5 has been removed from the installation portion 1*b* of the printer housing 1, the installation portion 1*b* is covered with a cover not shown, which can be fitted to the printer housing 1.

Inside of the printer housing 1, as shown in FIG. 1, there are mounted a pair of paper feed rollers 10*a*, 10*b* which during automatic paper-feeding feed cut paper sent by the picking roller 5*c* into the printing portion 4 between the printing head 2 and the platen 3, a pair of paper discharge rollers 11*a*, 11*b* which during automatic paper-feeding discharge printed cut paper which has been printed upon in the printing portion 4 out onto the paper receiving tray 9, and a paper feed motor 12.

Inside of the printer housing 1, as shown in FIG. 1, there are also mounted left and right horizontal guide plates 20 and 21 located on both sides of the platen 3, a guide plate 22 which together with the left-side guide plate 20 guides cut paper and continuous paper in the vicinity of the pair of paper discharge rollers 11*a* and 11*b*, a guide plate 23 which together with the left and right horizontal guide plates 20, 21 guides cut paper and continuous paper in the vicinity of the printing portion 4, a guide portion 24*a* which together with the right-side guide plate 21 guides cut paper and continuous paper in the vicinity of the pair of paper feed rollers 10*a*, 10*b*, and a guide member 24 which guides printed continuous paper diagonally upward toward a first continuous paper discharge slot 1*c* in the printer housing 1.

A paper switching claw 25, pivotally supported by means of a supporting shaft 25*a*, is disposed beneath the right-side horizontal guide plate 21. This paper switching claw 25 is pivotable between a first switchover position in which a portion of the claw 25 projects upward through an opening 21*a* in the right-side horizontal guide plate 21 and causes printed continuous paper sent toward the right of FIG. 1 by the pair of paper feed rollers 10*a* and 10*b* to be discharged toward the guide member 24 side and out through the first paper discharge opening 1*c*, and a second switchover position in which it does not project upward from the opening 21*a* and allows the printed continuous paper to move toward a second continuous paper discharge opening 1*d* in the printer housing 1.

The tractor 6 is, as shown in FIG. 1, pivotally mounted on the printer housing 1 by means of a supporting shaft 6*a*. This tractor 6 is pivotable between a first position (the position shown in FIG. 2) in which its upper end portion 6*b* engages with the underside of the paper receiving tray 9 and moves the paper receiving tray 9 into the manual paper-feeding position mentioned above, a second position (the position shown in FIG. 1) in which its upper portion 6*c* engages with the underside of the paper receiving tray 9 and moves the paper receiving tray 9 into the automatic paper-feeding position mentioned above, and a third position (the position shown in FIG. 3) where the upper end portion 6*b* engages with the underside of the paper receiving tray 9 and moves the paper receiving tray 9 into the closed position mentioned above.

In the tractor 6 there are mounted rotary claws, not shown, which engage with the feed holes at the edges of the continuous paper and send the continuous paper in the rightward direction of FIG. 3, an entrance guide portion 6*d* which guides continuous paper inserted through a continuous paper supply slot 1*e* in the printer housing 1 (or loaded inside the printer) to the rotary claws, and an exit guide portion 6*e* which guides continuous paper sent by the rotary claws toward the pair of paper discharge rollers 11*a*, 11*b*. When the tractor 6 is placed in the third position mentioned above, the end of the exit guide portion 6*e* is directed between the paper discharge rollers 11*a* and 11*b* (refer to FIG. 3).

The picking roller 5*c*, during automatic paper-feeding, is rotated in the direction of the arrow in FIG. 1 by a driving force from the paper feed motor 12 (or a separate motor). The rotation of the paper feed motor 12 is transmitted through a motor pinion gear 30 and an intermediate gear 31 to a gear 32 integral with the paper feed roller 10*a* and a gear 33 integral with the paper discharge roller 11*a*. The rotation of the paper feed motor 12 is also transmitted to the rotary claws, through the motor pinion gear 30, the intermediate gear 31, the gear 33, an intermediate gear 34 which meshes with this gear 33 and a gear 35 integral with the rotary claws which meshes with the intermediate gear 34 only when the tractor 6 is in the above-mentioned third position shown in FIG. 3.

The paper feed motor 12 is controlled by an electronic control section not shown, such that during automatic paper-feeding, shown in FIG. 1, it rotates the picking roller 5*c*, the paper feed roller 10*a* and the paper discharge roller 11*a* in the directions shown respectively by the arrows in FIG. 1, and when continuous paper is being used, as shown in FIG. 3, it rotates the gear 35 integral with the rotary claws, the paper discharge roller 11*a* and the paper feed roller 10*a* respectively in the directions shown by the arrows in FIG. 3. During manual paper-feeding, shown in FIG. 2, the paper feed motor is controlled by the electronic control section such that it rotates the paper discharge roller 11*a* and the paper feed roller 10*a* in the directions shown by the arrows in FIG. 2 until printing of the cut paper is completed, and then after printing is completed it rotates the rollers 10*a* and 11*a* in the reverse direction.

The tractor 6 is pivoted automatically or manually between the three positions mentioned above based on the push-operation of operating buttons, for example operating buttons for selecting manual paper-feeding, automatic paper-feeding, and continuous paper, mounted on an operating panel not shown. The switchover claw 25 also is automatically or manually pivoted between the two positions mentioned above.

Next, the operation of the embodiment having the above construction will be explained.

When the tractor 6 moves into the first position, shown in FIG. 2, the upper portion 6*c* of the tractor 6 engages with the underside of the paper receiving tray 9 and moves the paper receiving tray 9 into the manual paper-feeding position shown in FIG. 2. As a result, the end portion 9*a* of the paper receiving tray 9 moves away from the part 1*a* of the printer housing 1 and an opening portion for cut paper 7 which serves as the manual paper-feeding opening is formed, and it becomes possible for the paper receiving tray 9 to guide manually-fed cut paper into the opening portion 7. In this state, when cut paper is placed on the paper receiving tray 9 and manually fed, this cut paper passes through the opening 7, is sent in the rightward direction of FIG. 1 by the paper discharge rollers 11*a*, 11*b* and the paper feed rollers 10*a*, 10*b* rolling in the direction of the arrows of FIG. 1, is printed upon in the printing portion 4, and after printing is completed, is sent in the leftward direction of FIG. 1 by the paper discharge rollers 11*a*, 11*b* and the paper feed rollers 10*a*, 10*b* rolling in the reverse direction and discharged through the opening 7 onto the paper receiving tray 9.

With the cut sheet feeder 5 installed on the printer housing 1, when the tractor 6 moves into the second position shown in FIG. 2, the upper end portion 6*b* of the tractor 6 engages with the underside of the paper receiving tray 9 and moves the paper receiving tray 9 into the automatic paper-feeding position shown in FIG. 1. As a result, the end portion 9*a* of the paper receiving tray 9 moves away from the part 1*a* of the printer housing 1 and the opening portion for cut paper 7 which serves as the paper discharge opening is formed and it becomes possible for the paper receiving tray 9 to receive printed cut paper. In this state, when an operating button for starting printing, not shown in the drawings, is operated, cut paper loaded in the cut sheet feeder 5 is extracted one sheet at a time by the picking roller 5*c* and this extracted cut paper is sent by the paper feed rollers 10*a*, 10*b* to the printing portion 4 and is printed upon, and the printed cut paper is sent out by the paper discharge rollers 11*a*, 11*b* and discharged through the opening portion 7 onto the paper receiving tray 9.

With the cut sheet feeder 5 removed from the installation portion 1*b* of the printer housing 1 and the cover, not shown in the drawings, fitted onto the printer housing 1 and covering the installation portion 1*b*, when the tractor 6 moves into the position 3 shown in FIG. 3 the upper end portion 6*b* of the tractor 6 engages with the underside of the paper receiving tray 9 and moves the paper receiving tray 9 into the closed position shown in FIG. 3. As a result, the end portion 9*a* of the paper receiving tray 9 is caused to abut with the part 1*a* of the printer housing 1 and the opening portion for cut paper 7 is closed off.

In this state, when the operating button, not shown in the drawings, for starting printing is operated, printing of continuous paper is carried out with the opening portion 7 closed. Consequently, during printing using the continuous paper, noise produced inside the printer does not leak out to the outside through the opening portion 7, and during this printing there is less leakage of noise produced inside the printer to the outside.

It is noted that although in the above embodiment the paper receiving tray 9 is supported on the printer housing 1 by means of the supporting shaft 9*b* so as to pivot between the above-mentioned three positions, the printer may alternatively be constructed in such a way that the paper receiving tray 9 is mounted vertically movably on the printer housing 1 and the paper receiving tray 9 moves between the three positions by this vertical movement.

Also, although in the above embodiment the tractor 6 is supported on the printer housing 1 by means of the supporting shaft 6*a* so as to pivot between the above-mentioned three positions, the printer may alternatively be constructed in such a way that the tractor 6 is mounted vertically or horizontally movably on the printer housing 1 and the tractor 6 moves between the three positions by this vertical or horizontal movement.

As described in detail above, according to the first present invention, when the continuous paper feeding means moves into the first position this feeding means engages with the manually-fed paper guide plate and moves this guide plate into the distant position and as a result of this the guide plate moves away from the part of the printer case and the opening portion for cut paper is formed, and when the continuous paper feeding means moves into the second position this feeding means engages with the manually-fed paper guide plate and moves this guide plate into the closed position and as a result the guide plate abuts with the part of the printer and the opening portion for cut paper is closed.

According to the second present invention, when the continuous paper feeding means moves into the second position this feeding means moves the paper receiving tray into the closed position and as a result the paper receiving tray abuts with the part of the printer case and the opening portion for cut paper is closed.

According to the third present invention, when the continuous paper feeding means moves into the third position this feeding means engages with the paper receiving tray and moves this tray into the closed position and as a result the paper receiving tray abuts with the part of the printer case and the opening for cut paper is closed.

Consequently, the leakage to the outside of noise produced inside the printer during printing using continuous paper can be made low.

Figure 1:
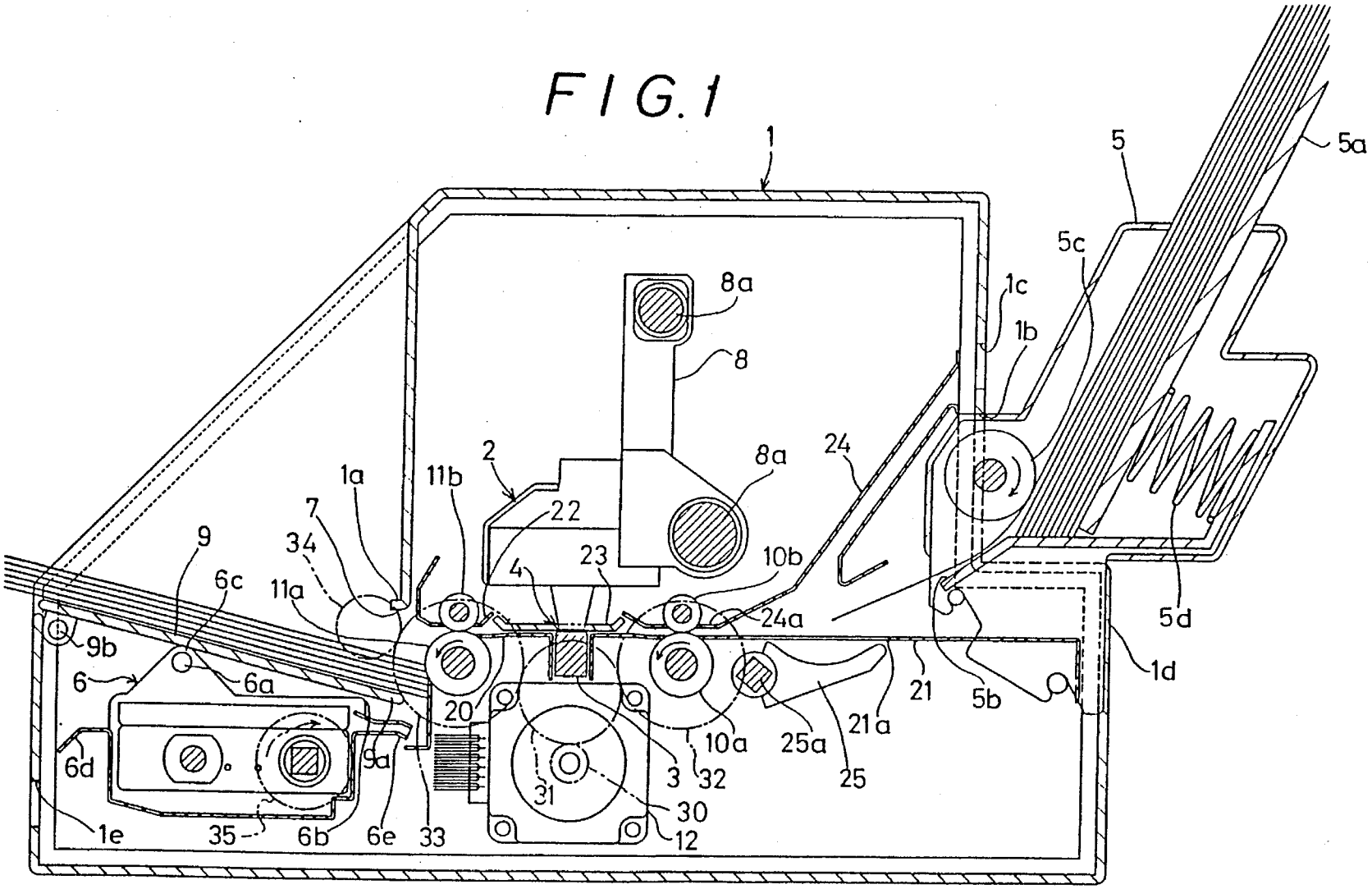
FIG. 1 A cross-sectional view illustrating a printer according to an embodiment of the invention and showing a state in which cut paper fed automatically is used.
Figure 2:
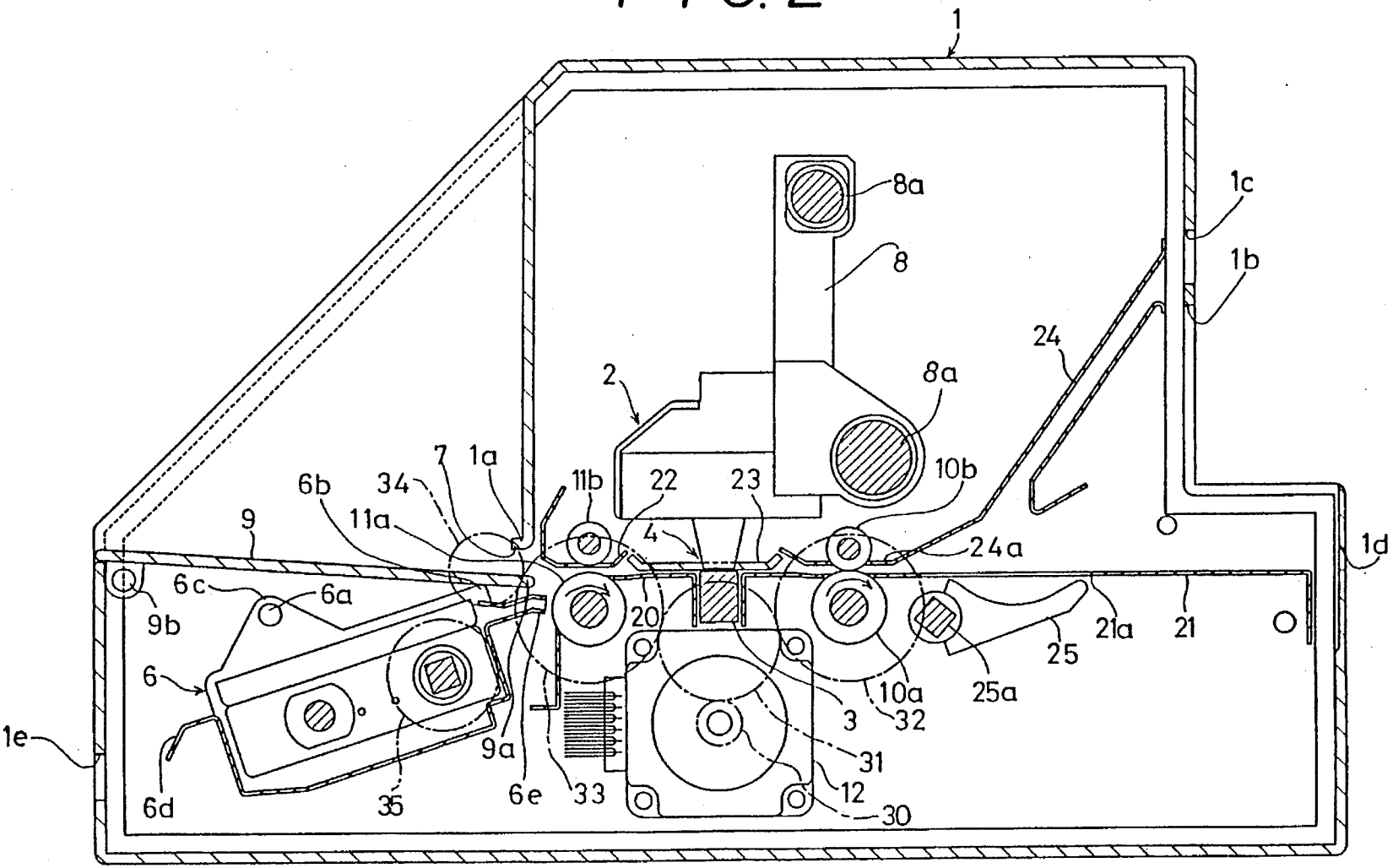
FIG. 2 A cross-sectional view similar to that of FIG. 1, illustrating a state in which cut paper fed manually is used.
Figure 3:
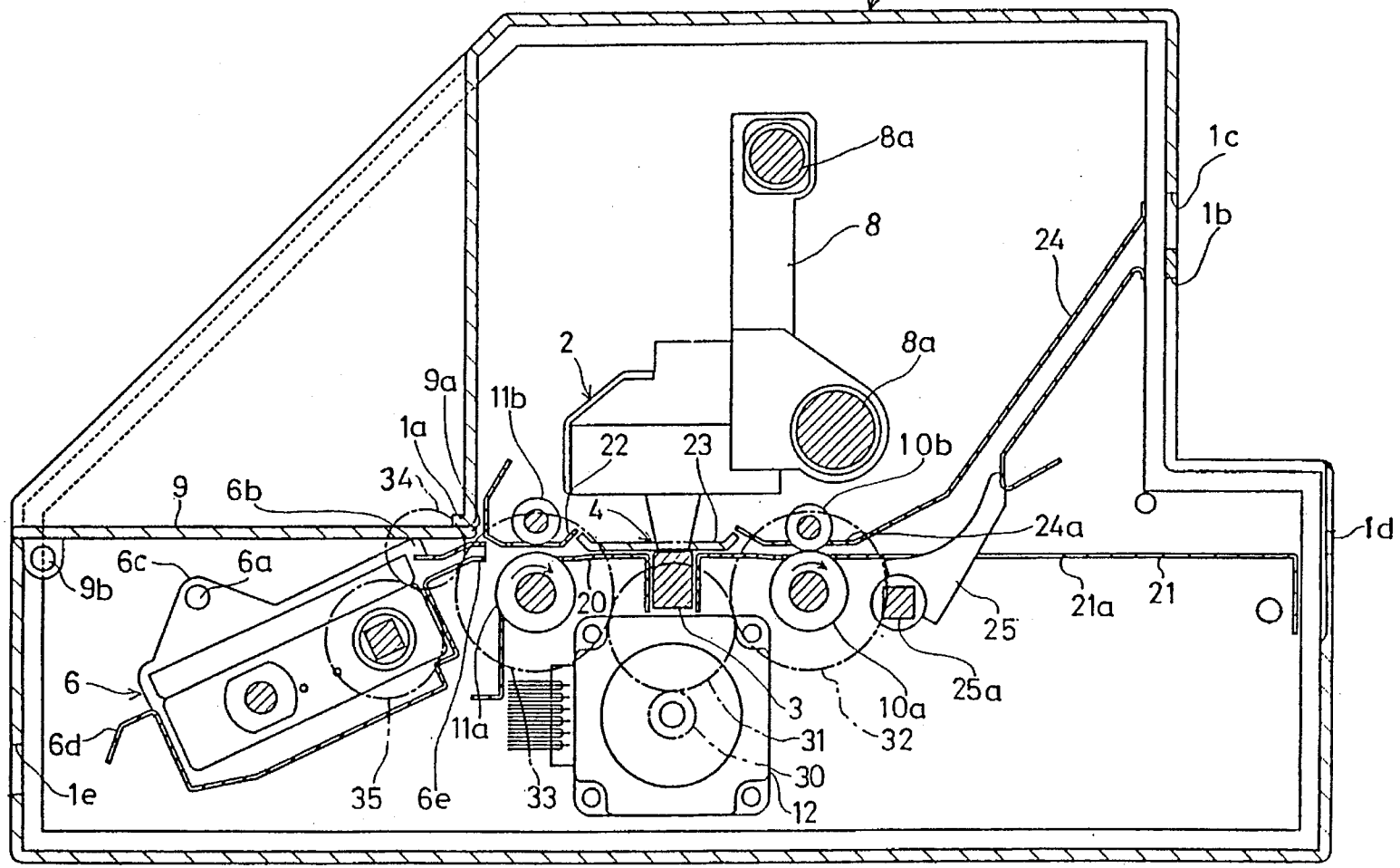
FIG. 3 A cross-sectional view similar to that of FIG. 1, illustrating a state in which continuous paper is used.

I claim:

1. A printer including an opening portion for cut paper for manually feeding sheets of cut paper into a printing portion between a printing head and a platen inside the printer and continuous paper feeding means for feeding continuous paper into said printing portion to selectively use manually-fed cut paper and continuous paper for printing, characterized in that:

the printer has a manually-fed paper guide plate which during manual paper-feeding guides cut paper into the opening portion and forms the opening portion between said guide plate and a part of the printer housing;

said guide plate is mounted on said printer housing, means being provided for moving said guide plate between a distant position where it is distant from the part of said printer housing and forms said opening portion and a closed position where it abuts with the part of said printer housing and closes said opening portion; and said continuous paper feeding means engages with said guide plate, means being provided for moving said feeding means between a first position at which said guide plate is moved into said distant position and a second position at which said guide plate is moved into said closed position.

2. A printer having a cut sheet feeder which automatically feeds sheets of cut paper into a printing portion between a printing head and a platen inside said printer and having continuous paper feeding means for feeding continuous paper into said printing portion to selectively use cut paper fed automatically by said cut sheet feeder and continuous paper for printing, characterized in that:

said printer has an opening portion for cut paper through which printed cut paper which has been automatically fed-in by said cut sheet feeder and printed upon in said printing portion is discharged to the outside;

said printer has a paper receiving tray which receives cut paper discharged through said opening portion and can form said opening portion between itself and a part of said printer housing;

said paper receiving tray is mounted on said printer housing, means being provided for moving said paper receiving tray between a distant position in which it is distant from said part of said printer housing and forms said opening portion and a closed position where it abuts with said part of said printer housing and closes said opening portion; and said continuous paper feeding means engages with the paper receiving tray, means being provided for moving said feeding means between a first position in which it causes said paper receiving tray to move into said distant position and a second position in which it causes said paper receiving tray to move into said closed position.

3. A printer having a cut sheet feeder for automatically feeding sheets of cut paper into a printing section between a printing head and a platen inside said printer and having an opening portion for cut paper which serves as a manual paper-feeding opening for manually feeding cut paper into a printing portion and also serves as a paper discharge opening for discharging printed cut paper to the outside during automatic paper-feeding and having continuous paper feeding means for feeding continuous paper into said printing portion to selectively use cut paper fed automatically by the cut sheet feeder, cut paper fed manually and continuous paper for printing, characterized in that:

said printer has a paper receiving tray which during manual paper-feeding becomes a guide member which guides cut paper into the opening portion and during automatic paper-feeding becomes a tray which receives printed cut paper, and which can form the opening portion between itself and a part of the printer housing;

said paper receiving tray is mounted on said printer housing, means being provided for moving said paper receiving tray between a manual paper-feeding position where it is distant from the part of said printer housing and forms said opening portion and during manual paper-feeding guides cut paper into said opening portion, an automatic paper-feeding position in which it is distant from said part of said printer housing and forms said opening portion and during automatic paper-feeding receives printed cut paper, and a closed position where it abuts with the part of said printer housing and closes said opening portion; and said continuous paper feeding means engages with said paper receiving tray, means being provided for moving said feeding means between a first position at which the paper receiving tray is moved into the manual paper-feeding position and a second position at which said paper receiving tray is moved into the automatic paper-feeding position and a third position at which the paper receiving tray is moved into the closed position.

* * * * *